United States Patent [19]

Westover et al.

[11] Patent Number: 4,723,773

[45] Date of Patent: Feb. 9, 1988

[54] SHEET FEEDING METHODS AND APPARATUS

[75] Inventors: Dwight G. Westover, Sierra Madre; Andrew J. Scherer, San Dimas, both of Calif.

[73] Assignee: Bell & Howell Company, Chicago, Ill.

[21] Appl. No.: 920,286

[22] Filed: Oct. 17, 1986

[51] Int. Cl.[4] ..... B65H 3/04

[52] U.S. Cl. ..... 271/10; 271/34; 271/110; 271/118; 271/122; 271/155; 271/251

[58] Field of Search ..... 271/34, 35, 117, 118, 271/10, 251, 110, 111, 155, 154, 275, 149

[56] References Cited

U.S. PATENT DOCUMENTS

| | | |
|---|---|---|
| 540,240 | 6/1895 | Dexter . |
| 1,626,352 | 4/1927 | Olson . |
| 1,668,816 | 5/1928 | Low . |
| 1,786,343 | 12/1930 | Griffith . |
| 1,987,339 | 1/1935 | Hitchcock . |
| 2,020,925 | 11/1935 | Young . |
| 2,028,236 | 1/1936 | Needham . |
| 2,132,231 | 10/1938 | Dunser . |
| 2,464,173 | 3/1949 | Broadmeyer . |
| 2,626,800 | 1/1953 | Martin . |
| 2,767,982 | 10/1956 | Noon . |
| 2,771,293 | 11/1956 | Guttridge . |
| 2,819,078 | 1/1958 | Durand . |
| 2,822,171 | 2/1958 | Luning . |
| 2,828,123 | 3/1958 | Guillemette . |
| 2,844,373 | 7/1958 | Van Marle . |
| 2,888,261 | 5/1959 | Barnes . |
| 2,933,313 | 4/1960 | Stobb . |
| 2,970,836 | 2/1961 | Smith . |
| 3,052,467 | 9/1962 | Fertig . |
| 3,079,151 | 2/1963 | Maidment . |
| 3,107,089 | 10/1963 | Lockey . |
| 3,107,090 | 10/1963 | Templeton . |
| 3,108,801 | 10/1963 | van Dalen . |
| 3,116,924 | 1/1964 | Huck . |
| 3,148,879 | 9/1964 | Kistner . |
| 3,174,749 | 3/1965 | Childs . |
| 3,195,887 | 7/1965 | Bean . |
| 3,265,385 | 8/1966 | Schulze . |
| 3,339,705 | 9/1967 | Burkhardt et al. . |
| 3,355,169 | 11/1967 | Seyl . |
| 3,368,701 | 2/1968 | Copping et al. . |
| 3,385,598 | 5/1968 | Kim . |
| 3,409,290 | 11/1968 | Bergland . |
| 3,514,098 | 5/1970 | Ostwald ..... 271/118 |
| 3,580,567 | 5/1971 | Hashimoto ..... 271/154 |
| 3,601,265 | 8/1971 | Shields . |
| 3,614,091 | 10/1971 | Bernardis . |
| 3,618,937 | 11/1971 | Follett . |
| 3,628,786 | 12/1971 | Maloney et al. . |
| 3,661,383 | 5/1972 | Morrison . |
| 3,744,790 | 7/1973 | Hoffman . |
| 3,761,079 | 9/1973 | Azure . |

(List continued on next page.)

FOREIGN PATENT DOCUMENTS

| | | |
|---|---|---|
| 2050685 | 5/1971 | Fed. Rep. of Germany . |
| 2119430 | 11/1972 | Fed. Rep. of Germany . |

(List continued on next page.)

OTHER PUBLICATIONS

J. Gutteling, IBM Technical Disclosure Bulletin, vol. 16, No. 11 (Apr. 1974).

(List continued on next page.)

*Primary Examiner*—F. J. Bartuska
*Assistant Examiner*—Lisa Waag
*Attorney, Agent, or Firm*—Benoit Law Corporation

[57] ABSTRACT

Sheet feeding systems provide a sheet receiving nip at a peripheral region of a rotary sheet transport and arrange sheets in a stack having a stack and formed by a bottom sheet and spaced from the nip by a distance shorter than the minimum length of any of the sheets. The stack is temporarily lifted from a stack rest, and the bottom sheet is removed therefrom. Sheet jams are prevented by advancing any bottom sheet to the rotary sheet transport in a plane intersecting that rotary sheet transport at a distance from the nip. Each bottom sheet is further advanced from that intersecting plane to the nip, and such advanced bottom sheet is engaged with the nip for transport away from the stack with the rotary sheet transport. The stack end is returned to the stack rest after said removal of a bottom sheet, and the temporary stack end lifting, sheet advancing, sheet engaging and stack end returning steps are repeated individually for further bottom sheets advanced from the stack end.

26 Claims, 9 Drawing Figures

U.S. PATENT DOCUMENTS

| | | |
|---|---|---|
| 3,790,162 | 2/1974 | Halbert . |
| 3,805,971 | 4/1974 | Behrens et al. . |
| 3,820,778 | 6/1974 | Veillard . |
| 3,861,516 | 1/1975 | Inose et al. . |
| 3,877,693 | 4/1975 | Gerbracht . |
| 3,880,420 | 4/1975 | Martin . |
| 3,881,721 | 5/1975 | Hitch . |
| 3,907,276 | 9/1975 | Gerbasi . |
| 3,917,258 | 11/1975 | Miller . |
| 3,944,217 | 3/1976 | Greene et al. . |
| 3,947,018 | 3/1976 | Stange . |
| 3,966,188 | 6/1976 | Maguire . |
| 3,980,296 | 9/1976 | Craft et al. . |
| 3,994,487 | 11/1976 | Wicklund . |
| 3,998,453 | 12/1976 | Dorer . |
| 4,012,034 | 3/1977 | Nelson . |
| 4,014,539 | 3/1977 | Goodwin . |
| 4,019,730 | 4/1977 | Staudinger et al. . |
| 4,030,723 | 6/1977 | Irvine et al. . |
| 4,032,135 | 6/1977 | Rüenzi . |
| 4,045,018 | 8/1977 | Michelson . |
| 4,067,568 | 1/1978 | Irvine . |
| 4,068,837 | 1/1978 | Lamos . |
| 4,072,305 | 2/1978 | Scheid et al. . |
| 4,082,263 | 4/1978 | Baumberger et al. . |
| 4,106,766 | 8/1978 | Stefansson . |
| 4,113,244 | 9/1978 | Rüenzi . |
| 4,116,556 | 9/1978 | Tanaka et al. . |
| 4,150,743 | 4/1979 | Lazzarotti et al. . |
| 4,163,491 | 8/1979 | Rock et al. . |
| 4,176,945 | 12/1979 | Holzhauser et al. . |
| 4,200,016 | 4/1980 | Helmig et al. . |
| 4,219,191 | 8/1980 | Rastorguyeff . |
| 4,241,909 | 12/1980 | Murphy et al. . |
| 4,303,234 | 12/1981 | Plum . |
| 4,333,640 | 6/1982 | Miller . |
| 4,350,332 | 9/1982 | Knight . |
| 4,362,298 | 12/1982 | Stefansson et al. . |
| 4,365,794 | 12/1982 | Roller . |
| 4,410,172 | 10/1983 | Holliday . |
| 4,418,874 | 12/1983 | Roldan . |
| 4,431,179 | 2/1984 | Westover et al. . |
| 4,437,658 | 3/1984 | Olson . |
| 4,444,388 | 4/1984 | Stefansson et al. . |
| 4,448,407 | 5/1984 | Bashford et al. . |
| 4,448,554 | 5/1984 | Driemeyer . |
| 4,483,530 | 11/1984 | Spencer et al. . |
| 4,514,799 | 4/1985 | Spencer et al. . |
| 4,522,385 | 6/1985 | Stefansson . |
| 4,533,135 | 8/1985 | Barker . |
| 4,573,674 | 3/1986 | Nogi et al. ..... 271/118 |

FOREIGN PATENT DOCUMENTS

| | | |
|---|---|---|
| 2328483 | 1/1974 | Fed. Rep. of Germany . |
| 2643906 | 3/1978 | Fed. Rep. of Germany . |
| 2914969 | 10/1980 | Fed. Rep. of Germany . |
| 637102 | 3/1962 | Italy . |
| 52-38225 | 3/1977 | Japan . |
| 55-52840 | 4/1980 | Japan . |
| 55-84744 | 6/1980 | Japan . |
| 141333 | 9/1982 | Japan . |
| 1000038 | 6/1983 | Japan ..... 271/117 |
| 1543122 | 3/1979 | United Kingdom . |
| 1583168 | 1/1981 | United Kingdom . |

OTHER PUBLICATIONS

F. M. Diel et al., IBM Technical Disclosure Bulletin, vol. 19, No. 9 (Feb. 1977), p. 3499.

C. G. Scouten et al., Xerox Disclosure Journal, vol. 3, No. 5 (Sep./Oct. 1978), p. 359.

Control Data Reader/Sorter, 1979 Hardware Maintenance Manual, by Magnetic Peripherals Inc.

MRS-9970 Installation and Maintenance Manual, by Lundy Electronics and Systems, Inc. (1985).

10
12
13
15
17
18
19
20
21
22
23
24
25
26
31
32
33
34
38
41
42
43
45
46
47
48
61
62
71
72
73
74
76
78
81
82
84
85
87
88
91
93
94
95
96
100
101
104
106
107
108
109
110
112
116
117
118
119
3
3
4A

SHEET FEEDING METHODS AND APPARATUS

FIELD OF THE INVENTION

The subject invention relates to sheet-handling systems, to sheet feeder systems, and to methods and apparatus for transporting documents, papers, sheet-like materials and sheets from a stack or along a sheet feeding path.

SUMMARY OF THE INVENTION

It is an object of this invention to provide improved sheet-handling systems.

It is a germane object of this invention to provide improved sheet transporting methods and apparatus.

It is a related object of this invention to provide improved sheet feeder systems.

It is also an object of this invention to provide improved methods and apparatus for transporting documents, papers, sheet-like materials, and sheets from a stack or otherwise along a sheet feeding path or to a given apparatus.

From one aspect thereof, the subject invention resides in a sheet feeding method or apparatus comprising, in combination, the steps of, or means for, providing a sheet receiving nip at a peripheral region of rotary sheet transporting means, arranging sheets in a stack having a stack end formed by a bottom sheet and spaced from the nip by a distance shorter than the minimum length of any of the sheets, placing the stack at the stack end against a stack rest, temporarily lifting the stack end from the stack rest, removing the bottom sheet from the lifted stack end, preventing sheet jams by advancing the bottom sheet to the rotary sheet transporting means in a plane intersecting the rotary sheet transporting means at a distance from the nip, further advancing the bottom sheet from the intersecting plane to the nip, engaging the advanced bottom sheet with the nip for transport away from the stack with the rotary sheet transport means, returning the stack end to the stack rest after the removal of a bottom sheet, and repeating the temporary stack end lifting, sheet advancing, sheet engaging and stack end returning steps individually for further bottom sheets advanced from the stack end.

From a related aspect thereof, the invention resides in sheet feeding methods or apparatus comprising, in combination, the steps of, or means for, providing a registration edge for guiding sheets being fed to an apparatus, providing a support of these sheets having a sheet support surface adjacent that registration edge, providing a first drive wheel at right angles to the sheet support surface and rotatable about an angularly movable first axis extending parallel to that sheet support surface, providing a second drive wheel rotatable about a second axis intersecting the first axis at an angle, providing the first wheel laterally with a circular driven part extending about the first axis in a tangential plane of the second wheel, positioning the first wheel at an initial angle to the registration edge and rotating that first wheel with the second wheel through the driven part about the first axis, bringing one of the sheets into peripheral engagement with the first drive wheel by inserting that one sheet in between the sheet support surface and the first drive wheel from an area of the sheet support surface across from the registration edge for peripheral engagement of that one sheet by the first drive wheel and transportation of that one sheet on the sheet support surface to the registration edge, laterally moving the circular driven part with the first wheel relative to the second wheel equidistantly about the second axis to swing the first wheel toward parallel relationship with the registration edge for transportation of the sheet along the registration edge until that one sheet has left the first drive wheel, whereby the first drive wheel is free to reposition itself to its initial angle to the registration edge, further rotating the swung first wheel with the second wheel through the driven part about the first axis to transport the sheet along the registration edge until that one sheet has left the first wheel, whereby the first wheel is free to reposition itself to its initial angle, moving the first wheel into, and releasably retaining the first wheel in, parallel relationship with the registration edge, inserting further sheets in between the sheet support surface and the first drive wheel from a region behind the first drive wheel relative to a direction of travel of the first drive wheel at the sheet support surface, and transporting the further sheets along the registration edge with the first wheel releasably retained in parallel relationship with the registration edge.

Other aspects of the invention will become apparent in the further course of this disclosure, and no restriction whatever is intended by this summary.

BRIEF DESCRIPTION OF THE DRAWINGS

The subject invention and its various objects and aspects will become more readily apparent from the following detailed description of preferred embodiments thereof, illustrated by way of example in the accompanying drawings, in which like reference numerals designate like or equivalent parts, and in which:

FIG. 4A is an elevation similar to FIG. 4A, showing part of a sheet handling apparatus not visible in FIG. 1;

DESCRIPTION OF PREFERRED EMBODIMENTS

Figure 1:
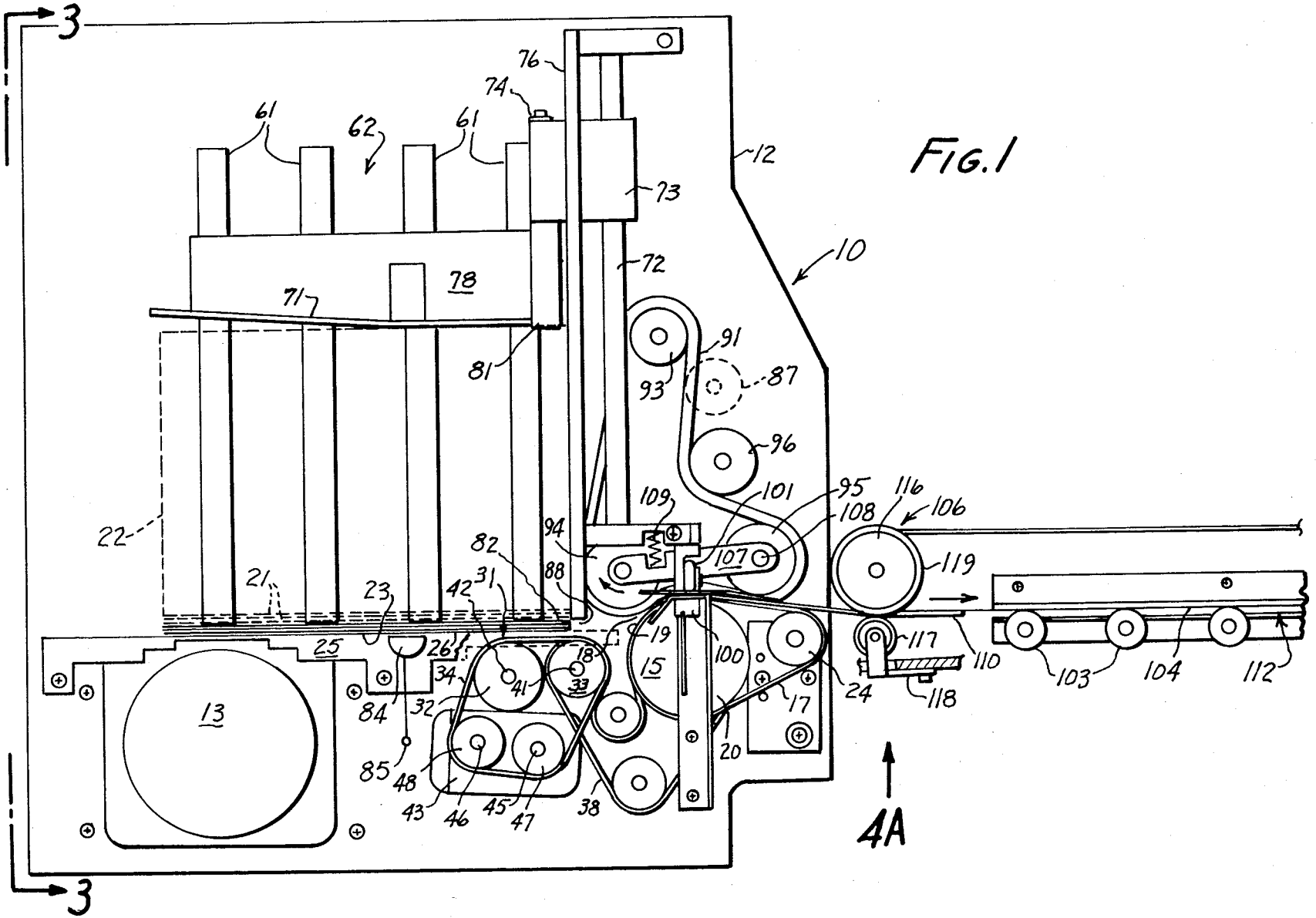
FIG. 1 is a plan view of a sheet feeding apparatus according to a preferred embodiment of the subject invention.

The sheet feeding apparatus 10 shown in the drawings has a baseplate 12 for mounting various components, including electric motors 13 and 14.

The main motor 13 drives rotary sheet transporting means 15 via a belt 16. The illustrated system provides a sheet receiving nip 18 at a peripheral region 19 of the rotary sheet transporting means 15.

Sheets 21 to be fed from the apparatus are received or arranged in a stack 22 having a stack end 23 formed by a bottom sheet 26 and spaced from the nip 18 by a distance shorter than the minimum length of any of the sheets which are either present in the stack 22 or for which the feeding apparatus 10 is designed.

The stack is placed at the stack end 23 against a stack rest 25. As shown in the enlarged detail view of FIG. 2, the stack end 23 is temporarily lifted from the stack rest 25 for the removal of a bottom sheet 26 from that lifted stack end.

Sheet jams are prevented by advancing the bottom sheet 26 to the rotary sheet transporting means in a plane 28 intersecting these rotary sheet transporting means 15 at a distance from the nip 18. The bottom sheet thus advanced along the plane 28 is further advanced from that intersecting plane to the nip 18.

In the illustrated embodiment of the subject invention, the means for removing each bottom sheet 26 from the stack end include the means for temporarily lifting that stack end 23 from the rest 25 preparatory to removal of that bottom sheet. By way of example, such means 31 include a first roller 32, a second roller 33, an endless belt 34 extending about these first and second rollers and means for driving that endless belt, including the primary motor 13.

Figure 2:
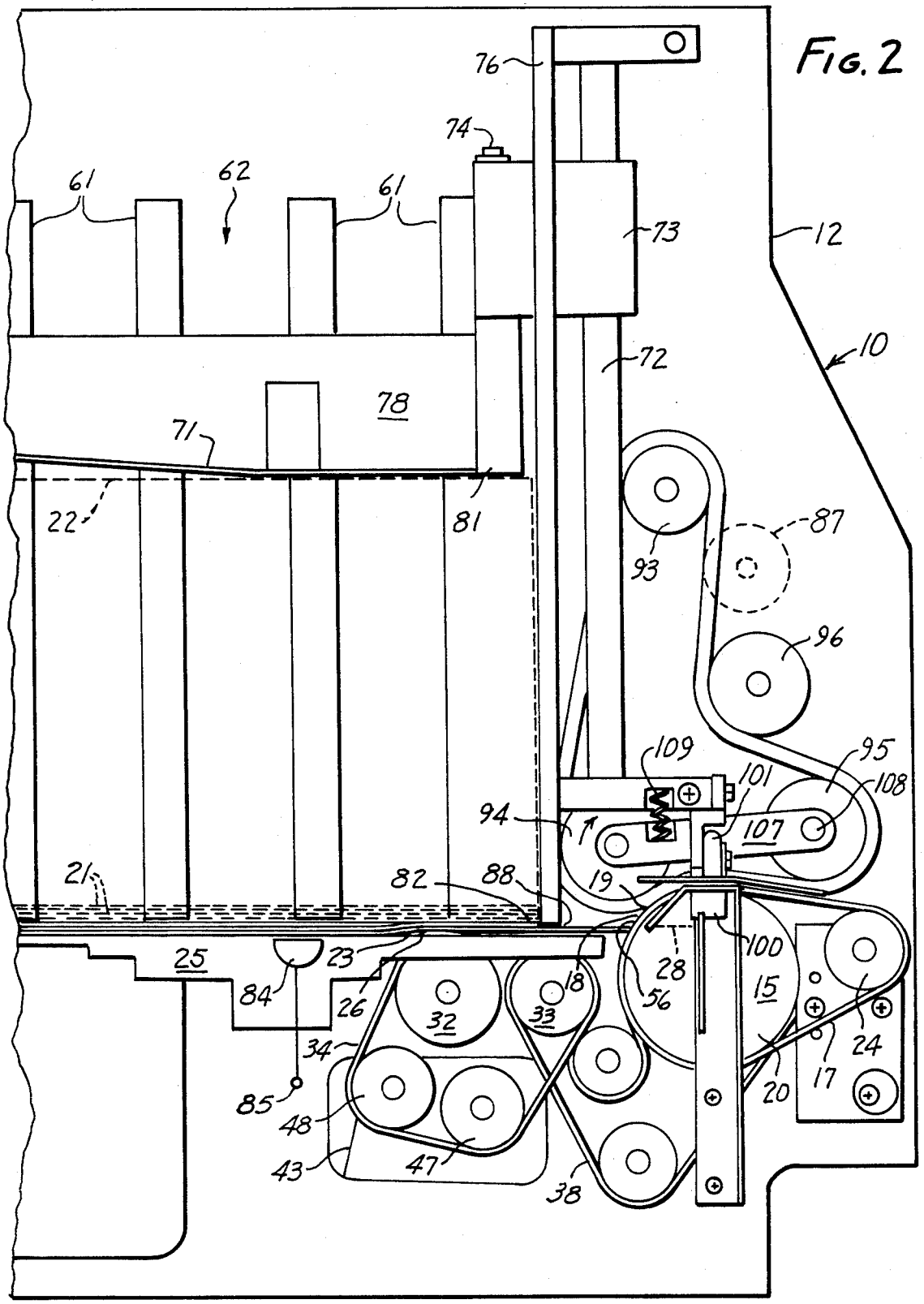
FIG. 2 is an enlarged detailed view of part of the apparatus of FIG. 1, showing sheet feeding means in an active position.

The means for temporarily lifting the stack end from its rest and for returning such stack end to that rest 25 after removal of a bottom sheet 26 include means 36 for positioning the first and second rollers 32 and 33 and the endless belt 34 in a retracted position spaced from the stack end, as shown in FIG. 1 within dotted lines. The endless belt 34 is then advanced with at least one of the first and second rollers 32 and 33 from its retracted position into the stack of sheets, in order to effect the lifting of the stack end 23 from its rest preparatory to removal of each bottom sheet with the endless belt 34 from the stack end, as shown in FIG. 2. One of the first and second rollers, such as the roller 33, is coupled to the motor 13 for driving the endless belt 34 clockwise, as seen in FIGS. 1 and 2, such as via belting 16 and 38, for instance. The means 36 for temporarily lifting the stack end 23 include means for pivoting at least the other roller 32 for movement relative to the one roller 33 or its rotational axis.

In the illustrated preferred embodiment of the invention, the roller 33 is rotatably mounted on a shaft 41 which is stationary relative to the baseplate 12. The roller 32, on the other hand, is rotatably mounted on a shaft 42 which projects from a mounting block 43, which may also carry shafts 45 and 46 on which further rollers 47 and 48 are rotatably mounted. In this manner, the endless belt 34 extends and advances in a clockwise direction around the rollers 32, 33, 47 and 48, as seen in FIGS. 1 and 2.

The roller mounting block 43 is pivoted around the stationary shaft 41 for angular movement relative thereto and to the drive roller 33 of the endless belt 34. An electric actuator 51 angularly moves a lever 52 in order to actuate the advancing belt 34 from its retracted position 37 to its advanced position for the removal of a bottom sheet 26 from the stack end. In the illustrated preferred embodiment, the angularly moving actuator lever 52 angularly moves the shaft mounting block 43 via a link 54 to actuate the bottom sheet drive belt between its retracted and active positions.

In this respect, the latter adjective "bottom" is intended to be sufficiently broad to cover not only the bottom sheet of a vertical stack, but also the first in or first out sheet of a horizontal or otherwise oriented stack, as shown by way of example in the drawings.

While the endless belt 34 in its active position thus removes the bottom sheet 26 from the lifted stack end 23, it not only advances such bottom sheet to the rotary sheet transporting means 15 in the plane 28 intersecting such rotary sheet transporting means at a distance from the nip 18 or the region 19, but also cooperates in further advancement of such bottom sheet from that intersecting plane 28 to the nip 18. The leading edge of the bottom sheet 25 thus advances through a peripheral region 56 of the rotating sheet :transporting means 15 to the region 19 at the nip 18.

The nip 18 thereupon engages the advanced bottom sheet 25 for transport away from the stack with the rotary sheet transport means 15. This operation and the subsequent removal of each sheet from the sheet transport means 15 are aided by an endless belt 17 extending around a roller 20 and idler 24. The rotating roller 20 also drives the belt 38 which rotates the roller 33 and thereby the sheet removal means 31.

The stack end 23 is returned to the stack rest 25 after the mentioned removal of the bottom sheet 26. In the illustrated preferred embodiment of the invention, the actuator 51 angularly moves the actuator lever 52 and linkage 54 so as to return the mounting block 43 to its rest position by angular movement about the stationary shaft 41. This consequently returns the set of rollers 32, 33, 47 and 48 and the sheet advancing belt 34 to their retracted position 37, and the stack end to the stack rest 25, preparatory to removal of the next bottom sheet from the stack 22.

The sheets 21 in the stack 22 are advanced toward the stack rest by such means as the endless belts 61 inlaid in or positioned at the baseplate 12 for that purpose. These endless belts are part of a sheet conveyor system 62 including a belt drive motor 63 driving a gear 64 rotating belt drive pulleys 65 in a rear region of the baseplate 12.

The conveyor belts 61 extend around idler pulleys 66 rotatably mounted by bearing blocks 67 at the lower side of the baseplate 12 near the stack rest 25.

The sheet receiving arrangement also includes a movable wall or hopper paddle 71 for containing the sheets 21 in a stack 22. As sheets are fed from the stack, the hopper paddle 17 moves along a shaft 72 with a slide bearing 73 to which the paddle is coupled by an articulate joint 74 permitting the paddle 71 to be swung away from and toward the baseplate 12 for insertion and removal of stacked sheets, as desired.

The hopper assembly also has a lateral sheet guide rail 76 extending toward the stack rest 25 and sheet removing belt 34.

In its active position, a mounting block 78 of the paddle 71 rests against the advancing conveyor belt 61, whereby the moving wall or hopper paddle 71 exerts pressure on the stack 22 and the sheets contained therein.

In the illustrated preferred embodiment of the subject invention, the hopper assembly includes means, such as a projection 81, for transmitting increased pressure along a side of the stack to aid further in a jam-free sheet feeding operation. In particular, the hopper assembly has a projection 81 surmounting the hopper paddle 71 for transmitting along the stack 22, to a corner 82 of the stack end 23 located closest to the rotary sheet transporting means 15, a pressure higher than a pressure generated by the advancing of the sheets in the stack toward the stack rest 25 by the conveyor belts 61 acting on the lower edges of the sheets 21 in the stack or acting on the stack via the area of the hopper paddle 71 apart from the projection 81 surmounting that area.

The illustrated preferred embodiment of the subject invention senses a pressure of the advancing sheets at the stack rest. For instance, where the conveyor system 62 advances sheets in the stack 22 towards the stack rest, pressure of such advancing sheets against or toward that rest 25 may be sensed by a pressure transducer 84 providing an electric pressure signal at a terminal 85. According to the illustrated embodiment, that terminal 85 is an input terminal of a hopper motor control 86 which controls energization of the conveyor system motor 63. The illustrated preferred embodiment thus suspends the advancing of sheets by the conveyor system 62 in the stack 22 toward the stack rest 25 in response to pressure sensed by a transducer 84, until that sensed pressure has become less than a predetermined value.

On the other hand, if stack pressure is about to become insufficient, then the pressure sensing transducer 84 will signal the motor control 86 via terminal 85 that the hopper motor 63 again has to be energized for driving the conveyor belts 61 and hopper paddle 71 toward increased stack pressure. This, then, is an additional feature according to the illustrated embodiment for assuring a perfect sheet feeding operation in the area of the lower corner 82 of the stack end.

The illustrated sheet feeder system restrains any further sheets from entering the nip 18 while any one bottom sheet is being transported away from the stack end 23 with the rotary sheet transport means. In the illustrated embodiment, such restraining means include an endless belt 91 of material having a higher friction than any of the sheets 21. A soft high-friction rubber or elastomer can be used for that purpose.

The belt 91 extends over and is kept in tension by several rollers and pulleys 93, 94, 95 and 96 of which one, such as the pulley 93, is driven by an electric motor 98. This or any equivalent approach assures that there is always a high-friction area at the back of the nip 18.

In the particularly illustrated case, the motor 98 causes movement of the endless belt 91 at the nip 18 contrary to, and at a lower rate than, the rotary sheet transporting means 15 thereat. This also restrains further sheets from entering the nip, while any one bottom sheet is being transported away from the stack end with the rotary sheet transport means 15. In this respect, the motor 98 may be a very slow moving motor or a stepping motor, for instance. One or more further idler rollers 87 may be added for increased wrap angle. A sheet metering gap 88 reduces jams by reducing the number of sheets that can proceed to the sheet transporting means 15.

In practice, the feeding of any bottom sheet 26 to the rotary sheet transport 15 in the above mentioned plane 28 according to the subject invention prevents sheet jams in and beyond the nip 18. The above mentioned temporary stack end lifting, sheet advancing, sheet engaging and stack end returning steps may be repeated individually for further bottom sheets advanced from the stack end. The actuator 51 may be repeatedly energized and the roller mounting block 43 recurringly moved angularly for that purpose.

A preferred embodiment of the subject invention senses presence of any further sheet 21 at the nip 18 after transport of any one bottom sheet with the rotary sheet transport means 15, and momentarily suspends the above mentioned temporary stack end lifting, sheet advancing, sheet engaging and stack end returning steps in response to that sensing of any further sheet at the nip. A photocell or other electrooptical sensing means 100 may be employed for that purpose at one side of the nip region. Light for the photoelectric sensor may be provided via a light source or guide 101 at the other side of the nip region. By way of example, the electrooptical sensor 100 sends a signal via a line 103 to a sheet feed control 104, which inhibits actuation of the motor 51 to an active position in response to sensing of a further sheet at the nip 18.

According to an embodiment of the subject invention, this further prevents sheet jamming at the nip 18, in that the endless belt 34 will not be moved from its retracted position and will thus not advance any further bottom sheet away from the stack 22, as long as there already is a further sheet at the nip 18 which, for instance, may have been dragged along by the preceding bottom sheet 26.

After any further sheet has been removed by the rotary sheet transport 15, the electrooptical sensor 100 senses an empty condition and accordingly signals the sheet feed control 104 to remove another bottom sheet from the stack by energization of the actuator 51 and corresponding angular movement of the roller mounting block 43, whereby the continuously advancing endless belt 34 is again pushed into the stack 22 to its active position, thereby temporarily lifting the stack end 23, advancing the next bottom sheet from the stack, transporting such bottom sheet along the plane 28 to the rotary sheet transport 15, and further to the nip 18 with the aid of that transort 15.

Any further sheet that may be dragged along by any advancing bottom sheet toward the rotary sheet transport 15 is not engaged by the endless belt 34 after the advanced bottom sheet has been removed from the stack, since the actuator 51 returns the endless belt 34 on rollers 42, etc., to the retracted position 37 each time an advanced bottom sheet has been engaged by the nip 18. In practice, the electrooptical sensor 100 may also be employed to control that phase of operation of the sheet feeder via control 104 and actuator 51.

In the illustrated sheet feeder 10, the nip 18 is jointly formed by the rotary sheet transporting means 15 and the high-friction belt 91 at the region 19.

In order to provide for a high-speed operation without incurring the risk of having successive sheets running into one another, each advanced bottom sheet 26, and each further sheet transported through the nip 18, is accelerated away from the rotary sheet transport 15. The electric motor 14 driving a sheet accelerator roller assembly 106 may be employed for that purpose.

Since it is important that all possible paper jams be avoided or quickly cleared, and that the operation of the roller assembly 106 be not affected thereby, the idler roller 94 in the illustrated preferred embodiment of the invention is rotatably mounted on a bar 107 shown only in FIGS. 1 and 2 to avoid crowding. That bar 107 may be pivoted about an axis 108 of the idler roller 95. The roller mounting bar 107 is biased by a spring 109 away from a precision stop.

A big problem with sheet feeding apparatus has been imprecise loading of the sheets. For instance, if a sheet in the stack is folded over at an edge, a jam may develop when that sheet is advanced from the stack. The spring-biased link bar 107 and floating condition of the roller 94 regularly allow clearance of such paper jams in the case of imprecise loading and otherwise. Wear of the foam belt 91 is also accommodated by the floating idler 94 to maintain the nip 18 constant.

Figure 4A:
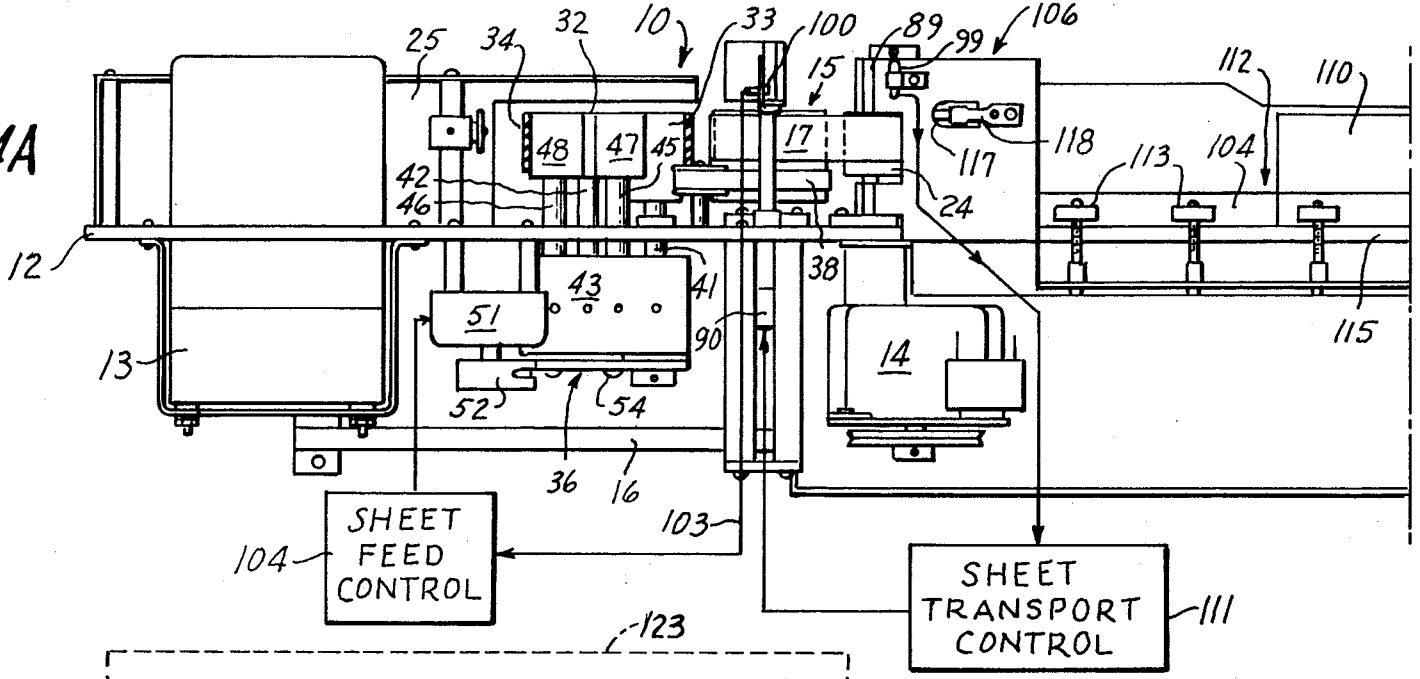
FIG. 4A is an elevation of the apparatus shown in FIG. 1, taken in the direction of arrow 4A in FIG. 1.

Sheet guides, one of which is seen at 89 in FIG. 4A, may be employed for facilitating the transition of each advancing sheet from the sheet transport means 15 or belt 17 to the sheet accelerator roller assembly 106. Such guides have been omitted from the showing of FIG. 1 in order to avoid overcrowding thereof. In practice, these sheet guides may be pivoted for removal of paper jams.

Also shown only in FIG. 4A is a photocell 99 which senses presence and absence of sheets 110, etc., at the roller assembly 106 and causes the sheet transport means 15 to be controlled accordingly. In this respect, a clutch 90 is interposed between the drive belt 16 and the sheet transport means 15. Clutch 90 is selectively energized and de-energized by a sheet transport control 111 in reponse to output signals of the photocell 99.

In this manner, the sheet transport 15 and the sheet removing means 31 are only energized from the motor 13 via clutch 90 when the roller assembly 106 is free to receive the next sheet. In other words, the sheet transport means 15 will not advance a sheet, as long as the roller assembly 106 is not ready therefor.

Conventional hardware, or software, may be employed for implementing the controls 86, 104 and 111 or their functions. This also applies to other controls herein described. In this manner, each sheet 100 may briefly be stopped at the roller assembly 106 or in the sheet feeding path 112 so that an operator can check that sheet or read data therefrom, as in the case of a bank check, remittance stub or other document.

The sheet drive belt 114 may be driven by the motor 14 via a roller 116 of the acceleration roller assembly 106 or in any other suitable manner so as to advance the sheets 110 along the path 112. In order to avoid the above mentioned risk of having successive sheets running into one another, the acceleration roller assembly 106 or roller 116 is driven at about twice the rate of the sheet transport 15 so that advancing sheets are rapidly removed therefrom and into the conveyor path 112.

One or more idler wheels 117 are rotatably mounted on flexible supports 118 and may circumferentially be covered with a high-frictional material cooperating with elastomeric or rubber O-rings 119 on the high-speed roller 116. Sheets 110 are thus quickly accelerated into the sheet feeding path 112 in between the advancing conveyor 114 and corresponding rollers 113.

Rollers 113 and 117 may be tilted somewhat downwardly in the direction of sheet advance to skew each sheet 110 into contact with a sheet bottom guiding rail 115 corresponding to the registration edge 121.

Each accelerated sheet 110 is advanced along a sheet feed path 112 equipped with rotating sheet feed rollers 113 and a conveyor belt 114 therealong as seen in FIGS. 4A and B. Sheets 110 transported from the stack 22 enter a sheet feeding substation 120 through a gate 141 controlled by a control 142 with photocell 143.

In particular, the sheet feeding substation 120 has a registration edge 121 for guiding said transported bottom sheets 110 and other sheets 123 being fed to remittance processing terminal or other apparatus 125. A support 126 for the transported bottom sheets 110 and other sheets 123 has a sheet support surface 127 adjacent the registration edge 121. Sheet drive wheels 128 are positioned adjacent the support 126 at an angle to the registration edge 121 and at right angles to the sheet support surface 126 for rotation about an axis extending parallel to that sheet support surface. As already disclosed in U.S. Pat. No. 4,362,298 by Rafn Stefansson, issued to the common assignee hereof on Dec. 7, 1982, for Angular-Linear Sheet Transports, and incorporated by reference herein, the mounting of each drive wheel 128 permits swinging, of that rotating wheel toward parallel relationship with the registration edge to transport any sheet along that registration edge 121.

As explained in U.S. Pat. No. 4,483,530, by William H. Spencer et al, issued Nov. 20, 1984, for Document Processing Systems, and incorporated by reference herein, a hopper 131, sheet drive wheels 132 and sheet drive motor 133 are provided for advancing and guiding the other sheets 123 into engagement with drive wheels 128 from an area 135 of the sheet support surface 127 across from the registration edge 121 for inducing a swinging of the rotating wheels 128 toward parallel relationship with the registration edge 121 and transport of any of said other sheets 123 along the registration edge with the swung drive wheels 128. In this respect, FIG. 5 shows details not shown in FIG. 4B to avoid crowding.

According to the illustrated preferred embodiment, wheel actuators 138 are provided for moving the drive wheels into, and releasably retaining these drive wheels 128 in, parallel relationship with the registration edge 121.

The sheet transport in the path 112 then individually inserts the transported bottom sheets 110 in between the sheet support surface 127 and the drive wheels 128 from a region 139 behind all drive wheels 128 relative to a direction of travel of these drive wheels at said sheet support surface 127 for transport of the bottom sheets 110 along the registration edge 121 with the drive wheels 128 releasably retained in parallel relationship with that registration edge.

Figure 5:
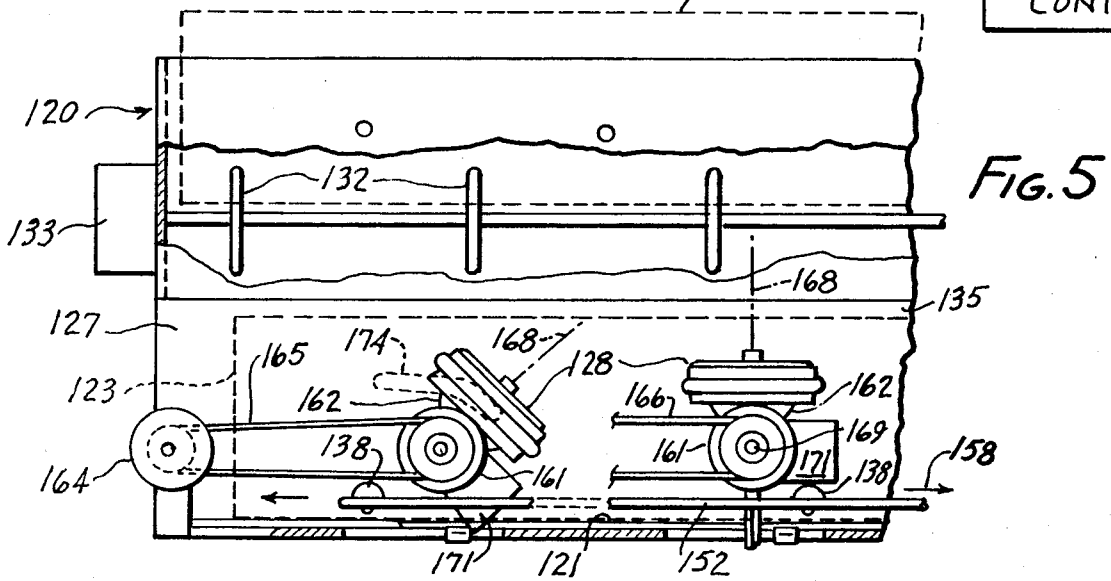
FIG. 5 is a detail view, on an enlarged scale, of part of the sheet handling apparatus shown in FIG. 4B.
Figure 4B:
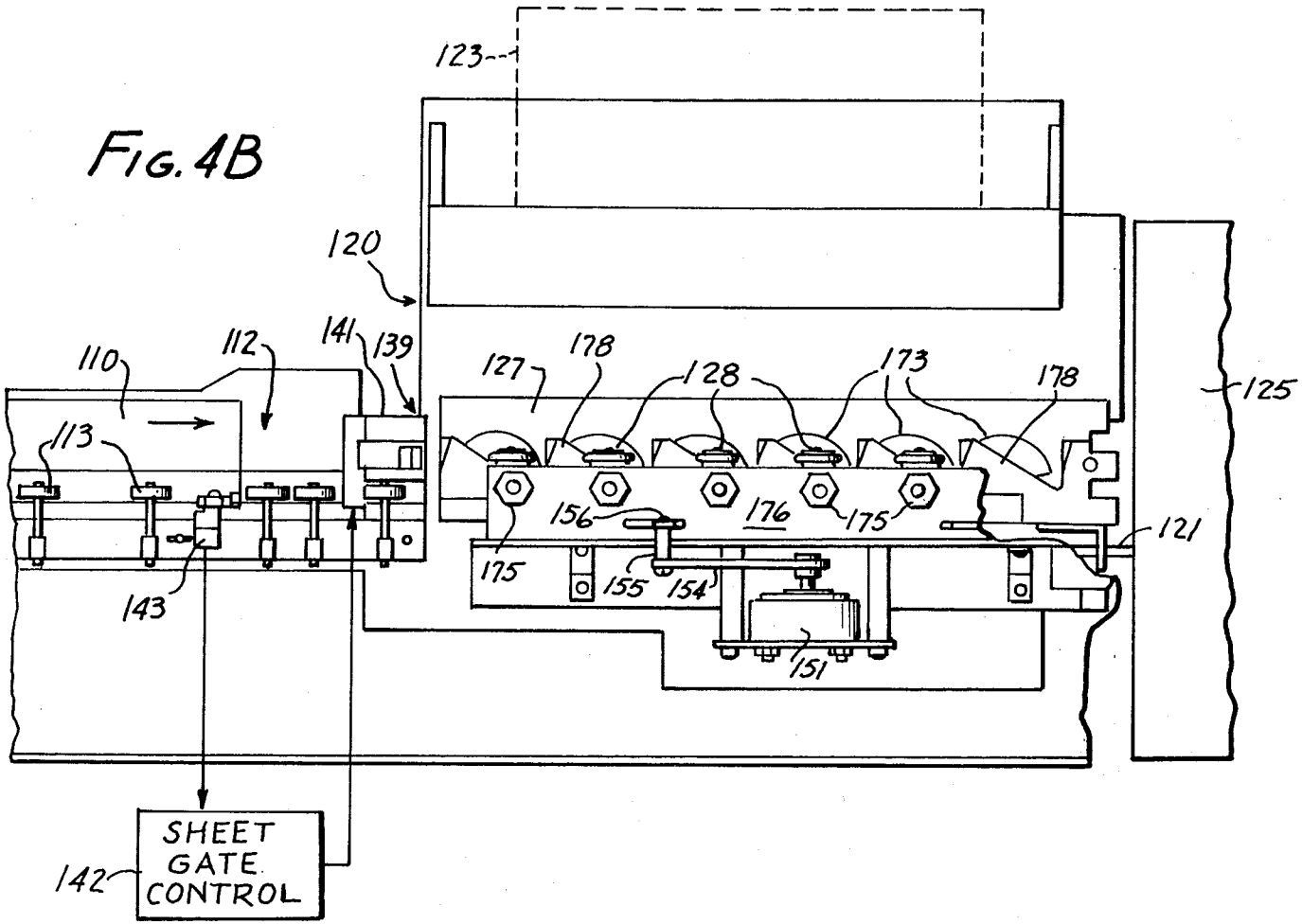

A rotary solenoid or motor 151, shown in FIG. 4B, serves to move the actuators 138 from their rest position shown toward the left of FIG. 5 to their active position shown toward the right of that FIG. 5. The support 152 for the actuators 138 is shown broken in FIG. 5, so as to enable an illustration of one actuator 138 and the corresponding wheel 128 in the rest position, and a simultaneous showing of another actuator 138 and its corresponding wheel 128 in the active position, as just mentioned in the preceding sentence.

Links 154, 155 and 156 couple the actuator support 152, and thereby the actuators 138, to the motor 151. That motor thus is enabled to move the support 152 and actuators 138 in the direction of the arrow 158 shown in FIG. 5 to the active position whereby the wheels 128 are pushed into parallel relationship with the registration edge 121. In that active position, the actuators 138 forcibly retain the wheels 128 in that parallel relationship with the registration edge, whereby these direct drive wheels 128 are enabled to drive or transport the sheets 110, arriving along the lateral sheet transport path 12, along the registration edge 121, to the remittance processing or other apparatus 125.

In other words, the sheets 110 are transported with the forcibly retained first wheels 128.

As disclosed in the above mentioned incorporated Stefansson et al patent, each angular sheet drive is provided with a second drive wheel 161 rotatable about the second axis intersecting the axis of rotation of the first drive wheel 128 at an angle, such as at a right angle.

Each first wheel 128 is laterally provided with a circular driven part 162 extending about the latter axis in a tangential plane of the second wheel 161.

As mentioned above, and as specifically illustrated to the left of the middle of FIG. 5, the first wheels 128 are initially positioned at an angle to the registration edge 121. A motor 164 or other drive rotates the second wheels 161 through belting 165 and 166. The first wheels 128 are thus rotated with the second wheels 161 through the driven part 162 about their first axes 168, whether the wheel 128 is tilted or whether it is erect.

When any sheet 123 is then brought in between the sheet support surface 127 and the first drive wheels 128, as disclosed above, the circular driven part 162 is laterally moved with the first wheel 128 relative to the second wheel 161 equidistantly about' the second axis 169 to swing the first wheel toward parallel relationship with the registration edge 121. At this point, this takes place while the actuators 138 are in their rest position.

The swung first wheel 128 is further rotated with the second wheel 161 through the driven part 162 about the first axis 168 to transport the sheet 123 along the registration edge 121 to the apparatus 125, until that sheet has left the first wheels, whereby such first wheels 128 are free to reposition themselves to the angle shown for the first wheel to the left of the middle of FIG. 5.

This process is repeated for each further sheet 123 that arrives from above or, broadly, from an area across from the registration edge 121.

On the other hand, if the gate 141 admits a sheet 110 arriving along the sheet feed path 112 to the sheet feeding substation 120, the motor 151 moves the support 152 and actuators 138 in the direction of the arrow 158 shown in FIG. 5, whereby the actuators 138 move the first wheels into, and releasably retain such first wheels 128 in, parallel relationship with the registration edge 121. The sheet 110 is then inserted through the gate 141 in between the sheet support surface 127 and the first drive wheel 128 from a region behind that first drive wheel relative to a direction of travel of that first drive wheel at the sheet support surface, or of the sheet 110 along the registration edge 121 to the apparatus 125.

Further sheets 110 may thus be transported along the registration edge 121 with the first wheels 128 releasably retained in parallel relationship with that registration edge, as already mentioned above.

Where each first wheel 128 is biased at the above mentioned initial angle to the registration edge, as shown to the left of the middle of FIG. 5, the active actuators 138 will then releasably retain such first wheels in the above mentioned parallel relationship to the registration edge against that biasing, as shown to the right of the middle of FIG. 5.

The latter biasing may be effected by weights 171 shown by way of example in FIG. 5. In that case, the actuators 138, when moved by the motor 151 in the direction of arrow 158, mechanically engage such weights for effecting the above mentioned moving of the first wheels 128 into, and for releasably retaining such first wheels in, the parallel relationship with the registration edge.

As seen in FIG. 4B, the sheet support surface 127 may be provided with plastic inserts 173 facilitating the operation of the sheet drive wheels 128. On the other hand, as shown in dotted outline in FIG. 5, the sheet support surface 127 may be provided with a groove 174, extending at an angle to the registration edge, so as to prevent the tire of the drive wheel 128 to wear on the sheet support surface 127 when no sheet is at that drive wheel. In practice, the groove 174, which may be provided at each drive wheel 128, provides a spaced relationship between the sheet support and the sheet drive wheel.

As already disclosed in the above mentioned incorporated Stefansson et al patent, the distance between the sheet drive wheel 128 and the sheet support surface 127 may be adjusted at the groove 174, or otherwise, by rotation of threaded bolts shown with hexagonal heads at 175. These bolts carry the wheel assembly at the shaft on which the second wheel 161 rotates. Since these bolts 175 are threaded in a mounting plate 176, the wheel assembly 128, 161 may be moved selectively toward and away from the sheet support surface 127 by appropriate rotation of these threaded bolts, as disclosed in the above mentioned incorporated Stefansson et al patent.

Each sheet 110 or 123 that is brought into peripheral engagement with a drive wheel 128 bridges the groove 174 with that sheet.

By way of example, a sheet 123 is brought into peripheral engagement with drive wheels 128 by inserting that one sheet in between the sheet support surface 127 and the drive wheels from an area of the sheet support surface across from the registration edge 121. In that manner, the groove 174 is bridged with that one sheet for peripheral engagement of that one sheet by the drive wheel and transportation of that one sheet on the sheet support surface 127 to the registration edge 121.

The rotating drive wheels 128 are swung toward parallel relationship with the registration edge to transport that sheet 123 along that registration edge until that one sheet has left each wheel 128, whereby such wheel is free to reposition itself at its initial angle to the registration edge 121.

The wheels 128 may then be pushed into parallel relationship with the registration edge by the actuators 138, which forcibly retain such drive wheels in that parallel relationship or erect position. Further sheets 110 may then be transported with such forcibly retained drive wheels, and the gap 174, if present, may be bridged also with laterally arriving further sheets 110. Again, the threaded bolts 175 are part of a mechanism coupled to the sheet drive wheels 128 for adjusting a distance between those sheet drive wheels and the sheet support surface at the grooves 174.

The driven part 162 in FIG. 5 may constitute a third wheel in driving engagement with the first wheel 128. That first wheel may then be rotated with the second wheel 161 through the third wheel 162 about the first axis 168. The third wheel 162 is subjected to swivelling movement with the first wheel 128 about the second axis 169 and about the second wheel 161, upon engagement of any of the sheets 123 with the first drive wheel 128. The swivelling movement of the first and third wheels 128 and 162 extends toward parallel relationship with the registration edge, for transportaion of any of the sheets 123 along that registration edge 121 upon further rotation of the swivelled first wheel 128 with the second wheel 161 through the third wheel 162 about the first axis 168. Sheets may be guided to the drive belts 128 by sheet guides 178 which assure the optimum delivery of laterally arriving sheets 110 and of downwardly arriving sheets 123 to the sheet support surface and drive wheels 128. In FIG. 4B, all sheet drive wheels 127 are shown in their erect position for transporting sheets 110 arriving from the sheet feeding path 112 through to the gate 141.

Figure 6:
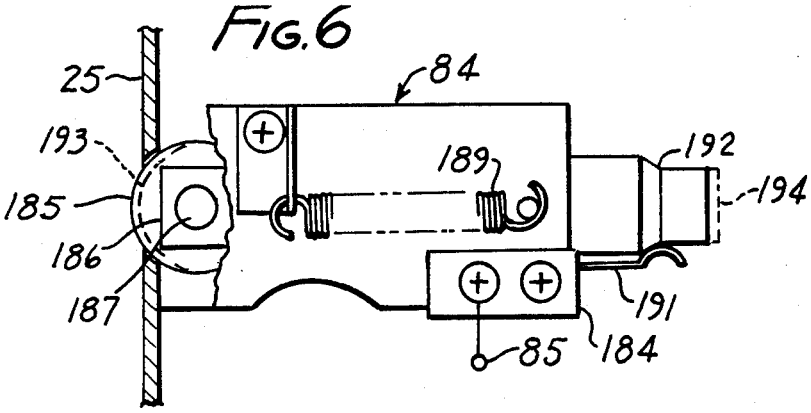
FIG. 6 is a detail view of a novel sensor switch usable in the embodiment of FIGS. 1 to 3 or in other sheet feeding apparatus.

According to the preferred embodiment of the invention illustrated in FIG. 6, the pressure transducer 84 shown in FIGS. 1 and 2 may be a sheet or pressure sensing switch 184 having a roller 185 and means, such as a stem 186, for mounting that roller for engagement by each bottom sheet 26 and for rotation during advancement of each bottom sheet along the stack rest 25. To this end, the roller 185 may be mounted by a shaft 187 on the stem 186 for rotation about that shaft. Roller bearings or other low-friction means may be employed for that purpose, to make sure that the pressure sensing function of the switch 184 in no manner interferes with the transport and sliding of each bottom sheet 26 along the stack rest 25.

Figure 3:
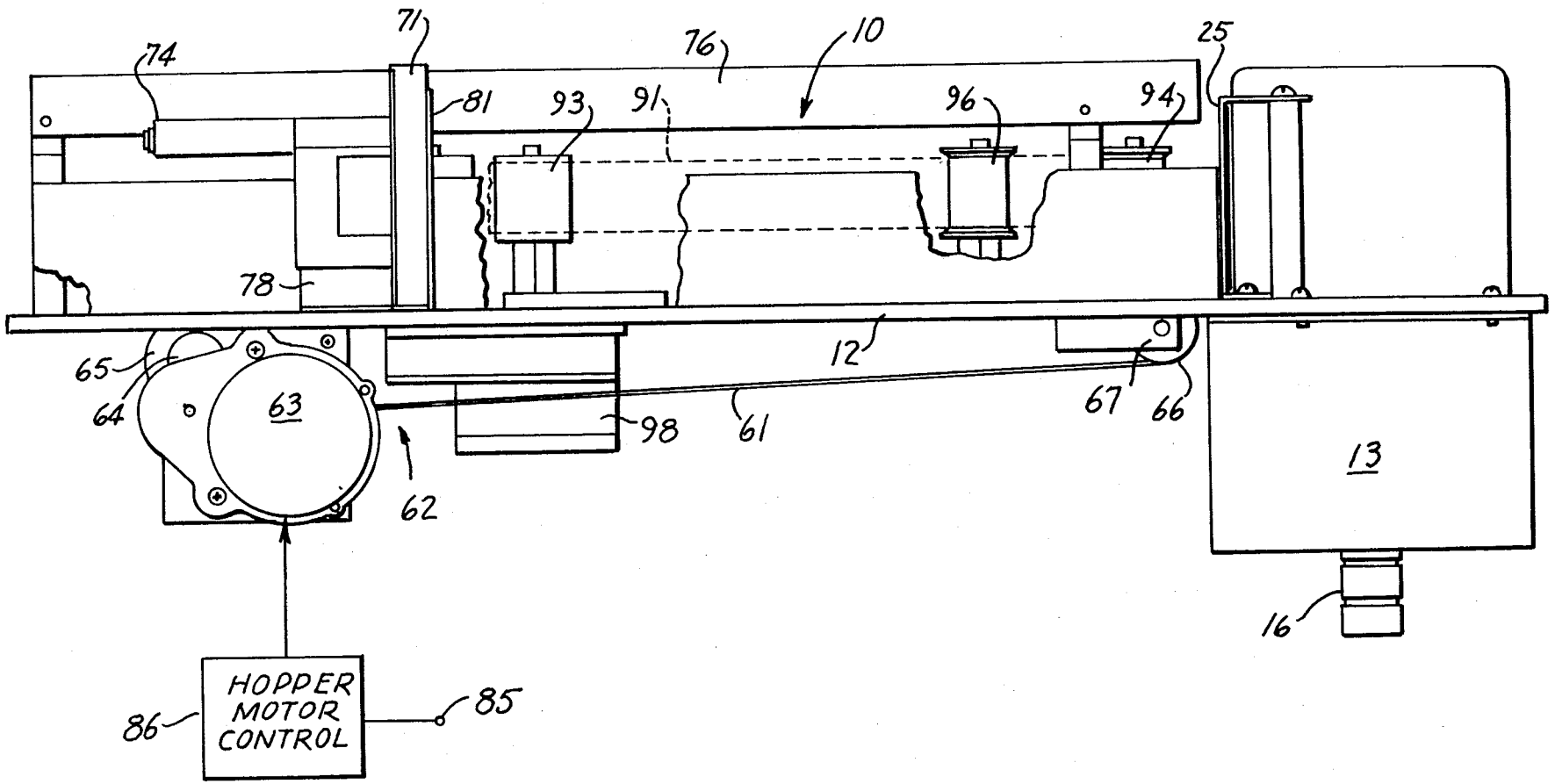
FIG. 3 is a side view, taken on the line 3—3 of FIG. 1.

The pressure sensor 184 includes a spring 189 for biasing the roller 185 against each bottom sheet 26. A switch actuator 191 has a free end resting against a free end 192 of the plunger 186. When a stack 22 or bottom sheet 26 depresses the roller 185 inwardly, as shown by dotted lines 193 in FIG. 6, the plunger 186 moves accordingly, as shown by dotted lines 194, thereby actuating the switch member 191 outwardly. This sends a signal via the terminal 85 to the hopper motor control 86 shown in FIG. 3.

Briefly, then, the sheet feeding apparatus according to the currently discussed aspect of the invention includes means, such as those shown in FIGS. 1 and 2, for reeiving sheets in a stack 22 having a stack end 23 formed by a bottom sheet 26, and including a stack rest 25. Means, such as those shown at 31, may be employed for removing each bottom sheet 26 from the stack rest 25.

A conveyor system 62, including conveyor belts 61 and drive motor 63, or other means are employed at the sheet receiver for advancing sheets in the stack 22 toward the rest 25. The sensor 84 constitutes a means at the rest 25 for sensing a pressure of the advancing sheets against that rest, as already mentioned above.

As seen in FIG. 6, the pressure sensor 84 includes a roller 185 and means, such as a switch actuator or stem 186 for mounting that roller for engagement by each bottom sheet 26 and for rotation during removal of each bottom sheet along that stack rest, such as in the manner explained above with respect to FIGS. 1 to 3. As shown in connection with FIG. 3, a hopper motor control 86 connected to the sensor switch 184 via terminal 85 serves to suspend operation of the sheet advancing means 61 to 63 in response to the sheet presence or pressure sensed by the switch 184, until that sensed presence or pressure has become less than a predetermined value, such as the bias represented by the soft spring 189 shown in FIG. 6, which biases the roller 185 against each bottom sheet 26.

The pressure sensing switch shown in FIG. 6 may be used in other apparatus or for other functions than in the apparatus shown in the remainder of the drawings.

Figure 7:
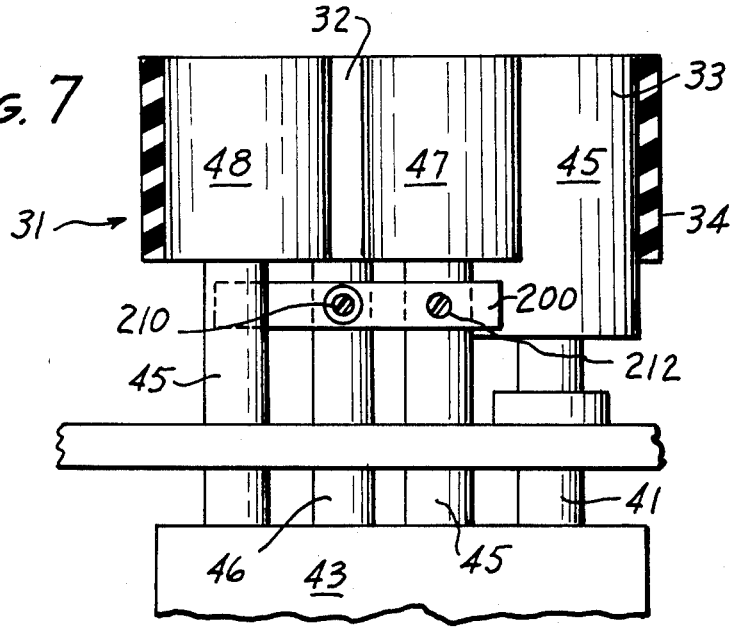
FIG. 7 is a detail side view of a sheet feeding belt transport with novel belt tracking system usable in the embodiment of FIGS. 1 to 3 or in other sheet feeding apparatus.
Figure 8:
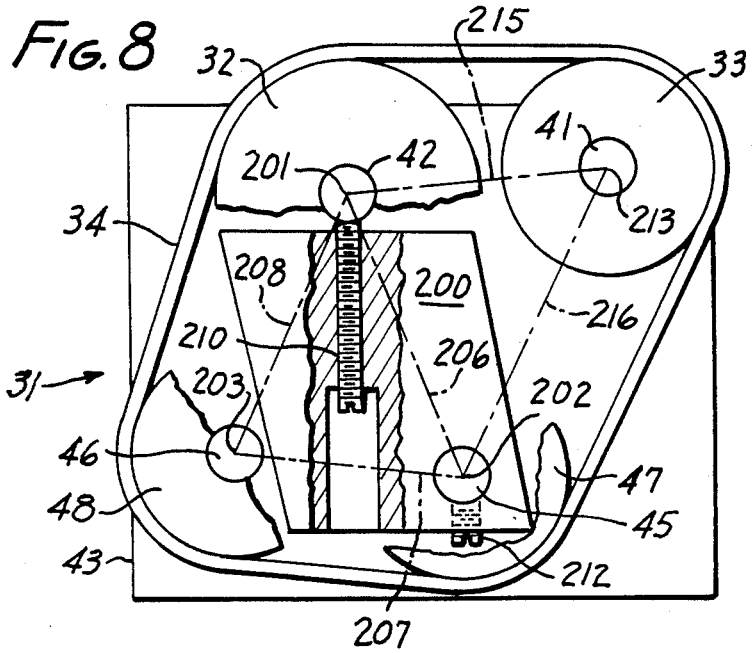
FIG. 8 is a top view of the belt transport of FIG. 7.

FIGS. 7 and 8 show means for adjusting the tracking of the endless belt 34, including means 200 for selectively tilting axes 201, 202 etc., of the rollers 32, 42, etc., relative to each other.

FIGS. 7 and 8 in essence show the bottom sheet removing means 31 on an enlarged scale, but it should be understood that the aspect of the invention shown in these figures is not limited in utility, structure or method to that embodiment.

A sheet feeding apparatus according to that aspect of the invention comprises at least three rollers 32, 47 and 48 having axes or centers of rotation 201, 202 and 203 interconnected by more than one line 206, 207 and, in this case, 208.

The sheet transport belt 34 extends around the rollers 32, 47 and 48 and is coupled to means for advancing the belt. By way of example, such belt advancing means may again include the motor 13, drive belt 16, clutch 90, belt 38 and roller 33. However, that obviously is not the only means for advancing the belt 34, and belt 38 has, therefore, not again been shown in FIGS. 7 and 8.

The means for adjusting tracking of the belt presently to be described, include the above mentioned means 200 for selectively tilting axes of the rollers 32, 47 and 48 relative to each other. These rollers have shafts 42, 45 and 46 on the axes or centers of rotation 201, 202 and 203. The above mentioned adjusting means include a tensioning plate 200 pivoted about one of the shafts, such as the shaft 45 and resting against another of the shafts, such as the shaft 46. Means, such as a set screw 210 threaded in the plate 200, are present for selectively tensioning or biasing the plate 200 relative to yet another of the shafts, such as the shaft 42, so as to adjustably tilt the other shafts 42 and 46 relative to the one shaft 45.

A further set screw 212 may be threaded into the plate 200 and may engage the shaft 45, to prevent the plate from moving up and down. However, that second set screw 212 may not actually be necessary, if its function may be performed by the first set screw 210 bearing against the shaft 42.

The shafts 42, 45 and 46 have a natural bias towards each other by virtue of their mounting in the block 43. When the set screw 210 is tightened, that set screw acts on the shaft 42, while the pressure plate, in turn, acts on the shaft 45, about which it is pivoted, and on the shaft 46, against which it rests. The shafts 42, 45 and 46 and thereby the axes of rotation 201, 202 and 203 are, therefore, tilted away from each other.

If the shaft 45 about which the plate 200 is tilted is considered as one of the shafts, then it may be said that the plate 200 and tensioning screw 210 adjustably tilt the other shafts 42 and 46 relative to that one shaft 45.

Such adjustable tilting also will take place when the set screw 210 is loosened, since the shafts 42, 45 and 46 then tend to return to their vertical positions imposed upon them by their mounting in the block 43.

In this manner, the tracking of the driven endless belt 34 may be adjusted upwardly and downwardly relative to the vertical. Such belt tracking adjustments, in turn, adjust the tracking of the sheets 21, including bottom sheet 26, along their path of advancement toward the further sheet transport 15 or toward such other apparatus as there may be in various applications of the principle disclosed with the aid of FIGS. 7 and 8.

In the embodiment shown in these figures, the axes of rotation 201, 202 and 203 of the rollers 32, 47 and 48 are located on apices of a triangle represented by the lines 206, 207 and 208, and the tensioning plate and screw 210 act accordingly.

In the particular embodiment, a fourth roller 33 having a shaft 41 is present, such as for belt mounting and driving purposes, as disclosed above in connection with FIGS. 1, 2 and 4. However, it should be understood that the belt 34 may be driven in other ways, such as by way of one of the rollers 32, 47 or 48. Even if the now fourth roller 33 is present, the drive of the belt 34 may still be effected via one of these other rollers.

The now fourth roller 33 has a shaft 41 or axis of rotation 213 located on a corner of a four-cornered figure represented by lines 207, 208, 215 and 216. The axes of rotation or shafts of the other three rollers 32, 47 and 48 are located on the remaining corners at 201, 202 and 203 of the four-cornered figure. The sheet drive belt 34 extends around all four of the rollers 32, 33, 47 and 48.

The latter four-cornered figure could be a rhomboid or trapezoid, and the tension plate 200 has a similar configuration, except that its corners could be rounded, if desired.

The subject extensive disclosure will render apparent or suggest to those skilled in the art various modifications and variations within the spirit and scope of the invention and equivalents thereof.

We claim:

1. In a sheet feeding apparatus, the improvement comprising in combination:

rotary sheet transporting means;

means for providing a sheet receiving nip at a peripheral region of said rotary sheet transporting means;

means for receiving sheets in a stack having a stack end formed by a bottom sheet, including a rest for spacing said stack end from said nip by a distance shorter that the minimum length of any of said sheets;

means for removing each bottom sheet from said stack end;

means for temporarily lifting said stack end from said rest preparatory to removal of said bottom sheet and for returning the stack end to said rest after said removal of a bottom sheet; and means for preventing sheet jams at said nip, including means at said rest for advancing each bottom sheet from said stack end to said rotary sheet transporting means in a plane intersecting said rotary sheet transporting means at a distance from said nip, and means for further advancing each bottom sheet from said intersecting plane to said nip for engagement by, and transport through, said nip by said rotary sheet transporting means.

2. Sheet feeding apparatus as claimed in claim 1, including:

means for restraining any further sheets from entering said nip while any one bottom sheet is being transported away from said stack end with said rotary sheet transport means.

3. Sheet feeding apparatus as claimed in claim 1, wherein:

said restraining means include an endless belt of material having a higher friction than said sheets, and means for moving said endless belt at said nip contrary to, and at a lower rate than, said rotary sheet transporting means.

4. Sheet feeding apparatus as claimed in claim 1, including:

means at said rotary sheet transport means for accelerating any advanced bottom sheet away from said rotary sheet transport means.

5. Sheet feeding apparatus as claimed in claim 1, including:

means for restraining any further sheet from entering said nip while any one bottom sheet is being transported away from said stack end with said rotary sheet transport means;

means for sensing presence of any further sheet at said nip after transport of any one bottom sheet with said rotary sheet transport means; and means connected to said sensing means, to said removing means and to said lifting means for momentarily suspending operation of said stack end lifting and bottom sheet removing means in response to sensing of said further sheet at said nip, while said further sheet is being engaged by, and transported through, said nip by said rotary sheet transporting means.

6. Sheet feeding apparatus as claimed in claim 1, including:

means for advancing sheets in said stack toward said rest; and means for transmitting along said stack, to a corner of said stack end located closest to said rotary sheet transporting means, a pressure higher than a pressure generated by said advancing of sheets in said stack toward said stack rest.

7. Sheet feeding apparatus as claimed in claim 1, wherein:

said means for removing each bottom sheet from said stack end include said means for temporarily lifting said stack end from said rest preparatory to removal of said bottom sheet.

8. Sheet feeding apparatus as claimed in claim 1, including;

a registration edge for guiding said transported bottom sheets and other shets being fed to an apparatus;

a support for said transported bottom sheets and other sheets having a sheet support surface adjacent said registration edge;

a sheet drive wheel;

means for positioning said sheet drive wheel adjacent said support at an angle to said registration edge and at right angles to said sheet support surface for rotation about an axis extending parallel to said sheet support surface, said positioning means including means permitting swinging of said rotating wheel toward parallel relationhip with said registration edge to transport any sheet along said registration edge;

means for guiding said other sheets into said engagement with said drive wheel from an area of said sheet support surface across from said registration edge for inducing said swinging of said rotating wheel toward parallel relationship with said registration edge and transport of any of said other sheets along said registration edge with the swung drive wheel;

means for moving said drive wheel into, and releasably retaining said drive wheel in, parallel relationship with said registration edge; and means for individually inserting said transported bottom sheets in between said sheet support surface and said drive wheel from a region behind said drive wheel relative to a direction of travel of said drive wheel at said sheet support surface, for transport of said bottom sheets along said registration edge with said drive wheel releasably retained in parallel relationship with said registration edge.

9. Sheet feeding apparatus as claimed in claim 8, wherein:

said means for moving and releasably retaining said first wheel include means for pushing said first wheel into said parallel relationship with said registration edge and for forcibly retaining said first wheel in said parallel relationship with said registration edge.

10. Sheet feeding apparatus as claimed in claim 1, including:

means at said sheet receiving means for advancing sheets in said stack toward said rest;

means at said rest for sensing a pressure of said advancing sheets against said rest; and means connected to said sensing means and said advancing means for suspending operation of said advancing means in response to said sensed pressure and until said sensed pressure has become less than a predetermined value.

11. Sheet feeding apparatus as claimed in claim 10, wherein:

said pressure sensing means include a roller, and means for mounting said roller for engagement by each bottom sheet and for rotation during advancement of each bottom sheet along said stack rest.

12. Sheet feeding apparatus as claimed in claim 1, wherein:

said means for removing each bottom sheet from said stack end include a first roller, a second roller, an endless belt extending about said first and second rollers and means for driving said endless belt; p1 said means for temporarily lifting said stack end from said rest and for returning the stack end to said rest after said removal of a bottom sheet include means for positioning said first and second rollers and said endless belt in a retracted position spaced from said stack and at said rest, and means for advancing said endless belt with at least one of said first and second rollers from said retracted position into said stack to effect said lifting of said stack end from said rest preparatory to removal of each bottom sheet with said endless belt from said stack end.

13. Sheet feeding apparatus as claimed in claim 12, wherein:

one of said first and second rollers is coupled to said means for driving said endless belt.

14. Sheet feeding apparatus as claimed in claim 12, wherein:

said means for temporarily lifting said stack end include means for pivoting the other of said first and second rollers, for movement relative to said one roller.

15. Sheet feeding apparatus as claimed in claim 12, including:

means for adjusting a tracking of said endless belt, including means for selectively tilting axes of said rollers relative to each other.

16. Sheet feeding apparatus as claimed in claim 12, wherein:

said means for removing each bottom sheet include third and fourth rollers for supporting said endless belt together with said first and second rollers, first, second and third shafts for said first, second and third rollers, respectively, means for mounting said shafts and a tensioning plate pivoted about one of said shafts and resting against another of said shafts, and means for selectively biasing said plate relative to yet another of said shafts so as to adjustably tilt said other shafts relative to said one shaft.

17. In a sheet feeding method, the improvement comprising in combination the steps of:

providing a sheet receiving nip at a peripheral region of rotary sheet transporting means;

arranging sheets in a stack having a stack end formed by a bottom sheet and spaced from said nip by a distance shorter than the minimum length of any of said sheets;

placing said stack at said stack end against a stack rest;

temporarily lifting said stack end from said stack rest;

removing the bottom sheet from said lifted stack end;

preventing sheet jams by advancing said bottom sheet to said rotary sheet transporting means in a plane intersection said rotary sheet transporting means at a distance from said nip;

further advancing said bottom sheet from said intersecting plane to said nip;

engaging said advanced bottom sheet with said nip for transport away from said stack with said rotary sheet transport means;

returning the stack end to said stack rest after said removal of a bottom sheet; and repeating said temporary stack end lifting sheet advancing, sheet engaging and stack and returning steps individually for further bottom sheets advanced from said stack end.

18. A sheet feeding method as claimed in claim 17, including the steps of:

restraining any further sheets from entering said nip while any one bottom sheet is being transported away from said stack end with said rotary sheet transport means;

sensing presence of any further sheet at said nip after transport of any one bottom sheet with said rotary sheet transport means;

momentarily suspending said temporary stack end lifting, sheet advancing, sheet engaging and stack end returning steps in response to sensing of said further sheet at said nip;

engaging said sensed further sheet with said nip for transport with said rotary sheet transporting means; and transporting said sensed further sheet past said rotary sheet transporting means.

19. A sheet feeding method as claimed in claim 17, including the steps of:

advancing sheets in said stack toward said stack rest;

sensing a pressure of said advancing sheets against said stack rest; and suspending said advancing of sheets in said stack toward said stack rest in response to said sensed pressure and until said sensed pressure has become less than a predetermined value.

20. A sheet feeding method as claimed in claim 17, including the steps of:

advancing sheets in said stack toward said stack rest; and transmitting along said stack, to a corner of said stack end located closest to said rotary sheet transporting means, a pressure higher than a pressure generated by said advancing of sheets in said stack toward said stack rest.

21. A sheet feeding method as claimed in claim 17, including the step of:

restraining any further sheets from entering said nip while any one bottom sheet is being transported away from said stack end with said rotary sheet transport means.

22. A sheet feeding method as claimed in claim 21, including the step of:

accelerating any advanced bottom sheet away from said rotary sheet transport means.

23. A sheet feeding method as claimed in claim 22, including the steps of:

providing a registration edge for guiding said sheets;

providing a support of said advanced bottom sheets and other sheets, having a sheet support surface adajcent said registration edge;

providing a first drive wheel at right angles to said sheet support surface and rotatable about an angularly movable first axis extending parallel to said sheet support surface;

providing a second drive wheel rotatably about a second axis intersecting said first axis at an angle;

providing said first wheel laterally with a circular driven part extending about said first axis in a tangential plane of said second wheel;

positioning said first wheel at an angle to said registration edge and rotating said first wheel with second wheel through said driven part about said first axis;

individually bringing said other sheets into peripheral engagement with said first drive wheel by inserting each other sheet in between said sheet support surface and said first drive wheel from an area of said sheet support surface across from said registration edge for peripheral engagement of each other sheet by said first drive wheel and transportation of each other sheet on said sheet support surface to said registration edge;

laterally moving said circular driven part with said first wheel relative to said second wheel equidistantly about said second axis to swing said first wheel toward parallel relationship with said registration edge for transportation of each other sheet along said registration edge until that other sheet has left said first drive wheel, whereby said first drive wheel is free to reposition itself to said angle to said registration edge;

moving said drive wheel into, and releasably retaining said drive wheel in, parallel relationship with said registration edge;

inserting said advanced bottom sheets in between said sheet support surface and said drive wheel from a region behind said drive wheel relative to a direction of travel of said drive at said sheet support surface; and transporting said advanced inserted bottom sheets along said registration edge with said drive wheel releasably retained in parallel relationship with said registration edge.

24. A sheet feeding method as claimed in claim 23, including the steps of:

pushing said first drive wheel into said parallel relationship with said registration edge;

forcibly retaining said first drive wheel in said parallel relationship with said registration edge; and transporting said advanced inserted bottom sheets with said forcibly retained first drive wheel.

25. In a sheet feeding apparatus, the improvement comprising in combination:

means for receiving sheets in a stack having a stack end formed by a bottom sheet, including a stack rest;

means for removing each bottom sheet from said stack end;

means at said sheet receiving means for advancing sheets in said stack toward said rest;

means at said rest for sensing a pressure of said advancing sheets against said rest, including a roller, and means for mounting said roller for engagement by each bottom sheet and for rotation during removal of each bottom sheet along said stack rest; and means connected to said sensing means and said advancing means for suspending operation of said advancing means in response to said sensed pressure and until said sensed pressure has become less than a predetermined value.

26. Sheet feeding apparatus as claimed in claim 25, wherein:

said pressure sensing means include a spring for biasing said roller against each bottom sheet.

* * * * *